US009668584B2

(12) United States Patent
Green

(10) Patent No.: US 9,668,584 B2
(45) Date of Patent: Jun. 6, 2017

(54) MEDITATION SUPPORT

(75) Inventor: Ronald Green, Mount Tremper, NY (US)

(73) Assignee: Dharma Communications, Inc., Mount Tremper, NY (US)

( * ) Notice: Subject to any disclaimer, the term of this patent is extended or adjusted under 35 U.S.C. 154(b) by 771 days.

(21) Appl. No.: 11/606,612

(22) Filed: Nov. 30, 2006

(65) Prior Publication Data

US 2007/0074349 A1 Apr. 5, 2007

Related U.S. Application Data

(63) Continuation of application No. 10/921,198, filed on Aug. 18, 2004, now abandoned.

(51) Int. Cl.
*A47C 16/04* (2006.01)
*A47C 15/00* (2006.01)
*A47C 7/02* (2006.01)

(52) U.S. Cl.
CPC ..... *A47C 15/004* (2013.01); *A47C 7/021* (2013.01); *A47C 16/04* (2013.01)

(58) Field of Classification Search
CPC ..... A47C 16/04
USPC ..... 5/653, 740, 632, 648; 297/219, 297/423.11–423.12
See application file for complete search history.

(56) References Cited

U.S. PATENT DOCUMENTS 3,900,648 A * 8/1975 Smith ..... 5/636
4,064,578 A * 12/1977 Yamada ..... 297/452.27
D355,077 S * 2/1995 Tegner ..... D6/334
6,141,807 A * 11/2000 Tapper ..... 5/653
6,159,574 A * 12/2000 Landvik et al. ..... 428/71
6,175,980 B1 * 1/2001 Gaither ..... 5/654

* cited by examiner

*Primary Examiner* — Fredrick Conley
(74) *Attorney, Agent, or Firm* — Alfred M. Walker; John F. Vodopia

(57) ABSTRACT

Mediation sitting cushions and mats allow the user to meditate in comfort for great lengths of time, avoiding stress and pain often caused by traditional meditation cushions and mats. The layered mediation sitting cushions and mats combine a slow recovery visco-elastic foam ("VEF"), having load deformation properties and densities, with one or more base layers of a batting support. The sitting cushions and mats enable a person seated in traditional meditative positions to achieve a comfortable posture, regardless of the meditator's size or weight. The sitting cushions and mats also allow people to meditate in traditional cross-legged or kneeling postures comfortably, without irritation or pain. The mediation sitting cushions and mats also maintain of the pelvis in a neutral or slightly anterior position, resulting in proper alignment of the pelvis and spine, which minimizes the muscular and ligamentous strain caused by sitting in stillness for long periods of time.

7 Claims, 3 Drawing Sheets

MEDITATION SUPPORT

RELATED APPLICATIONS

This application is a continuation of application Ser. No. 10/921,198, filed Aug. 18, 2004 and claims priority under 37 C.F.R. §120 therefrom.

TECHNICAL FIELD

This disclosure relates to meditation supports, such as a meditation cushion or mediation mat, or a combination thereof, which incorporate a visco-elastic foam that promotes proper posture and comfort for sitting in meditation.

BACKGROUND

Historically, the sitting cushion used in meditation—called a zafu—has been round and low, frequently having dimensions of approximately 7 inches high and 16 inches in diameter. The traditional filling in zafus is kapok, a natural fiber obtained from Kapok tree seedpods. In the 2500 year history of meditation cushions, traditionally a meditation cushion is a single composite of cushioning material within an outer cover, not a cushion of layered materials.

A person mediating would typically be seated in a cross-legged fashion on zafu sitting cushion. In these postures, the legs are crossed or folded in front of the sitter in what is called "lotus posture" or one of its variations. The meditator's knees can rest on the floor and the cushion supports his or her sit bones. Alternatively, meditators use a kneeling posture called seiza. In this kneeling posture, the person's weight and bones which contact the cushion are again supported (by the cushion) which the meditator straddles.

Under the cushion is a meditation mat called zabuton. The typical measurements for such mats is approximately 32" by 27" and 3-6" high. A traditional mat has cotton batting contained in a seamed natural or synthetic cover. The zabu ton provides the meditator with a kind of "pillow" for the legs, giving some added support, warmth, and protection from the hard floor underneath. With prolonged use, the mat will eventually compress, becoming thin and less able to support the meditator's weight in a comfortable manner. Even when the mat is new and full, it lacks the ability to accommodate to the specific body weight of the meditator without over compressing, which results in the meditator's knees pressing against the hard floor.

Mediation cushions of kapok have commonly noted problems associated with their use.

There are two main reasons why sitting in meditation causes physical pain: First, the sitting bones are not elevated at the proper height. When the height isn't right for the individual, there is stress on knees and/or ankles that causes pain. Both too-high seats and too-low seats cause problems. In general, the more flexible an individual is, the lower the seat can be without causing difficulty.

Second, the sitting cushion is too hard. In this case the unforgiving material pressed against the buttocks blocks circulation, presses on nerves and causes discomfort and pain or complete loss of feeling.

The traditional material for meditation cushions is kapok. An individual kapok cushion can be adjusted for height and firmness by added or removing material. However, there is a limit due to the compressibility of the kapok itself. If a relatively high seat is required (as when the meditator has limited flexibility in hips and knees) the amount of kapok need to achieve that height is so great that it produces a seat that is extremely firm. The firm seat causes a problem because it is too hard.

This is the sitting cushion dilemma. If the cushion is stiff enough to give enough lift, it is also likely to cause pressure problems because of that very stiffness.

With buckwheat hulls it is possible to achieve greater lift with much less material, because the material does not compress. At the same time, as with a fully stuffed kapok cushion, a buckwheat hull seat is very hard and causes discomfort when used for extended periods.

Typically meditators deal with these limitations by shifting back and forth among imperfect alternatives, since difficulties usually take a few sitting periods to become extreme. Up until now the only other solution (which is not available to all) is to increase flexibility or lose weight to the point where a relatively soft kapok cushion is adequate to achieve a comfortable height.

Kapok-filled cushions are very firm initially, and soften gradually over time. Both the initial firmness and the long-term softness present physical difficulties for meditators. A new kapok cushion is usually too hard for most meditators. Its firmness frequently results in numbness to the legs and genitals lasting for the duration of the meditation period, and sometimes beyond. As the cushion softens, it loses its 'loft' and begins to sink. This results in a softer but lower cushion, which can cause additional strain on the bent knees and back from a lower than comfortable position. Although additional kapok can be added to the cushion, kapok does present certain hazards during handling. The fine cotton-like strands can be irritating when inhaled and thus necessitate the use of a mask when handling kapok.

Most significantly, the ever-changing nature of kapok leads to a constant variation in cushion density and height, which in turn results in less than consistent comfort for the meditator. Common complaints associated with the use of kapok-filled cushions include: back pain, knee pain (due to cushions that are either too high or too low), pain over the sacrum (tail bone) from pressure of the unyielding cushion, and numbness in the legs or genital area due to pressure on the sciatic nerve or other nerves running near the 'sit bones' that bear the weight in meditating.

Sitting cushions sometimes contain only buckwheat hulls and also generate common problems associated with physical discomfort, particularly numbness in the legs where the edge of the bucket-filled cushion contacts the sciatic nerve area under the buttock. In addition, pain in the sacral area or on the 'sit bones' themselves commonly occurs due to the unyielding nature of the buckwheat hulls. The buckwheat hulls, while having some ability to shift and 'hold' the weight of the person's buttocks, are a virtually incompressible material and thus 'push back' onto the offered weight, frequently creating discomfort.

Meditators typically sit completely motionless for some time, often approximately from 20 minutes to an hour. During longer retreats held periodically at meditation or religious centers and/or monasteries, meditators may sit for twelve or more 35-minute periods per day. Physical discomfort, which at times can be significant, frequently appears. The pain associated with meditation is most commonly present in the knees, ankles, hips, back and neck, and older meditators are particularly susceptible to it. However, younger people also have limitations such as previous injuries, arthritis, and/or chronic illness which create pain while sitting still for long periods of time. In addition, there is the general stiffness and discomfort that are the natural result of sitting still in one position over long periods of time. Lastly, meditating at all is difficult for some people, especially if they are unable to find a cushion and mat that will allow them to participate in the meditation sessions comfortably, without having to bear significant pain. For these reasons, there is at present a real need for a meditation cushion and mat that alleviate the discomfort associated with seated meditation.

OBJECTS OF THE INVENTION

It is therefore an object of the present invention to provide a meditation support which allow the user to meditate in comfort and avoid the stress and pain often caused by previously known types of cushions and mats.

It is also an object of the present invention to provide a meditation support to enable a person seated in traditional meditative positions to achieve a comfortable posture, regardless of the meditator's size or weight.

It is also an object of the present invention to provide a meditation support which maintains the pelvis in a neutral or slightly anterior position, resulting in proper alignment of the pelvis and spine during meditation.

It is yet another object to provide cushions and mats that allow meditators who have painful conditions and have no available means to meditate in the traditional cross-legged or kneeling postures, to be able to do so in a comfortable way as provided by the different and superior advantages of the present invention over previously crafted cushions and mats.

It is further an object to provide cushions and mats to meditators that accommodate the weight-bearing and weight-supporting body structures by maximizing the surface area that holds the weight in contact with the supporting cushion or mat during meditation.

It is also the object of the present invention to provide cushions and mats that prevent or limit numbness or pressure-caused pain in the knees, legs, genital and buttock, and thigh areas, by combining visco-elastic foam and supporting materials.

SUMMARY

In keeping with these objects and others which may become apparent, the present invention includes a mediation support which includes a sitting cushion including a layer of slow recovery, low resilience, temperature sensitive foam and a layer of supportive material that provides a firm base of support. An optional mat includes a layer of slow recovery, low resilience, temperature sensitive foam, an upper layer of cotton batting, and a lower layer of cotton batting. Individually or in combination the cushion, and/or mat provide support for a user in a meditative state, with the spine in a comfortable position of alignment.

The cushion of the present inventions relieves pain that is unrelieved by traditional cushions. The cushion uniquely combines a soft flexible accommodative foam with a firm base of buckwheat that is supportive and maintains the essential height.

In that case, both pain sources identified above are avoided.

The new cushion design is a solution for those who are too heavy or too stiff to use kapok comfortably. It solves the problem by using a base layer that provides lift, while adding a surface layer that is so soft and enveloping that it creates no pressure points. The result, at last, is lift without pressure.

Of course, in a sense this is not an original principle. The traditional buggy seat or chair, in which a horsehair layer is positioned over a web of springs is another expression of the same principle of providing a supportive base with a cushioning layer. The difference in the present invention is that the cushioning layer is an ideal cushioning material, and the supportive base is a proven material. Either one of these alone is inadequate. The combination of these two is not likely, since the visco-elastic foam, in the context of sitting cushions, is far too soft and compressible to be considered a suitable meditation cushion material.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION

Figure 3:
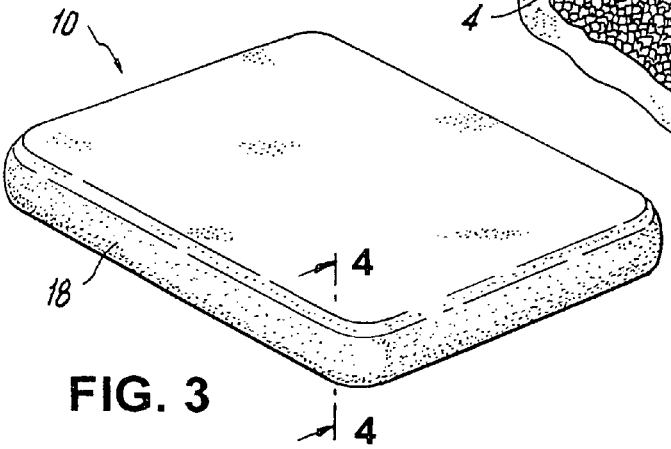
FIG. 3 shows a perspective view of a zabuton sitting mat.
Figure 4:
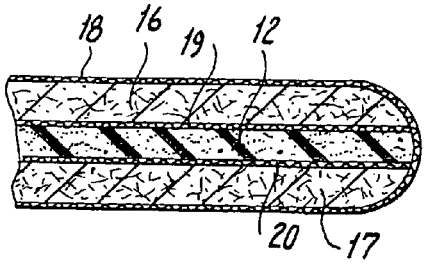
FIG. 4 shows a cross sectional detail view of a portion of the zabuton mat, taken along arrows "4-4" of FIG. 3, showing the zabuton mat having three sections shown, a layer of cotton batting, a layer of visco-elastic foam, and a layer of cotton batting.
Figure 5:
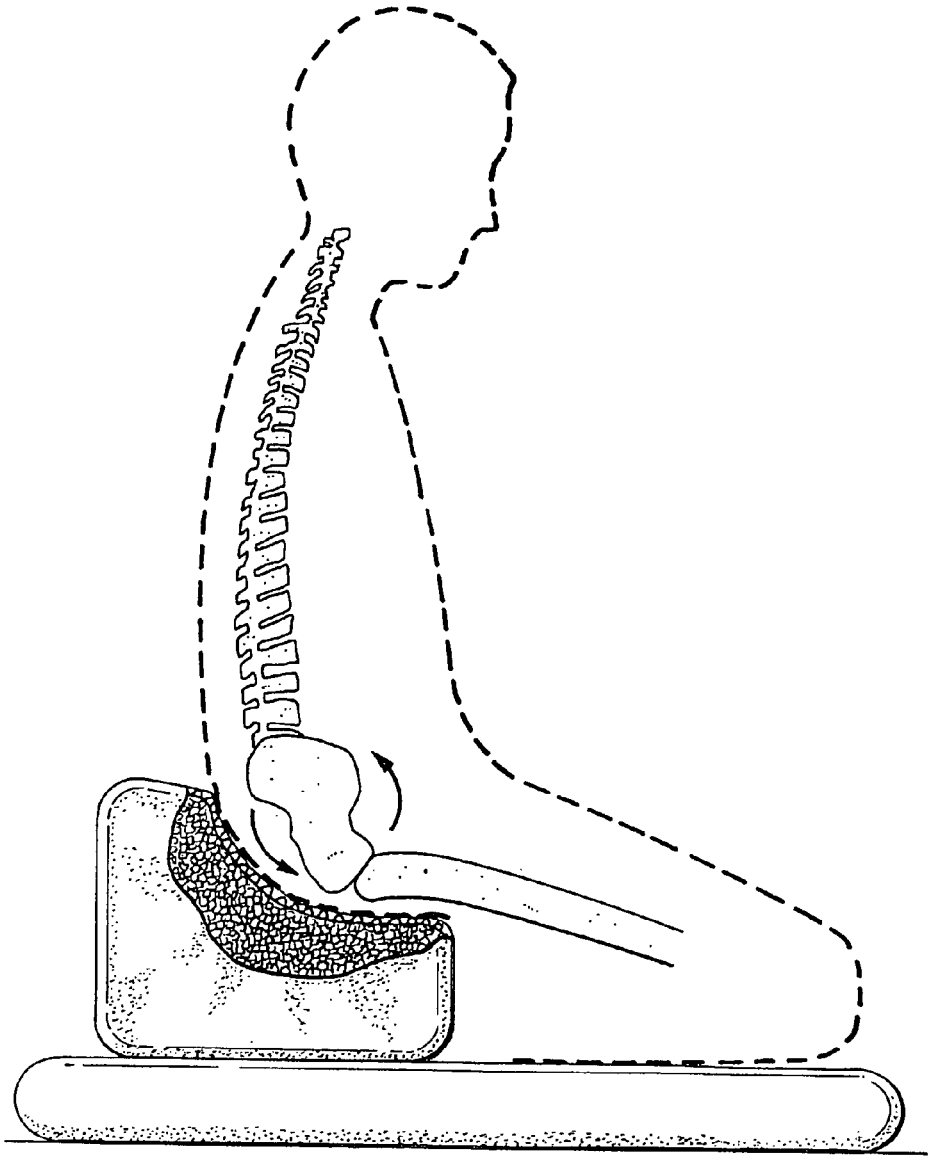
FIG. 5 (Prior Art)
FIG. 5 shows a prior art silhouette of a person seated in meditation on a standard; previously-known, non visco-elastic zabuton and standard, previously-known, non visco-elastic zafu, with a misaligned spinal position and a negative pelvic tilt; shown by the directional arrows therein; and, FIG. 6 shows a silhouette of a person seated in meditation on a sitting cushion zafu of this disclosure, and a zabuton of this disclosure, with the resultant proper spinal alignment in a neutral or slightly anterior position, with a positive pelvic tilt shown by the directional arrows therein.

As shown in FIGS. 1-4 and 6, the present disclosure relates to mediation sitting cushions and mats, such as sitting cushion 1 and mat 10, individually or in combination, which allow the user to meditate in comfort and avoid the stress and pain often caused by previously known types of prior art buckwheat cushions and cotton mats, shown in FIG. 5, especially for those who meditate for great lengths of time.

Mediation sitting cushion 1 and mat 10 combine a slow recovery visco-elastic foam ("VEF"), having load deformation properties and densities, with buckwheat layers, or similar materials such as kapok, buckwheat hulls, or cotton batting support. Meditation sitting cushion 1 and mat 10 enable a person seated in traditional meditative positions to achieve a comfortable posture, regardless of the meditator's size or weight. Meditation sitting cushion 1 and mat 10 also allow people who often have no other available venue to meditate in the traditional cross-legged or kneeling postures comfortably, without irritating or causing painful conditions.

Meditation sitting cushion 1 and mat 10 accommodate the weight-bearing and weight-supporting body structures by maximizing the surface area that holds the weight in contact with the sitting cushion 1 or mat 10 during meditation. Meditation cushion 1 and mat 10 also prevent or limit numbness, or pressure-caused pain, in the knees, legs, genital and buttock, and thigh areas, by combining visco-elastic foam and supporting materials.

Meditation sitting cushion 1 and mat 10 also maintain of the pelvis in a neutral or slightly anterior position, resulting in proper alignment of the pelvis and spine. Proper alignment minimizes the muscular and ligamentous strain caused by sitting in stillness for long periods of time.

Mediation sitting cushion 1, which may be provided in various dimensions, with different heights and amount of base material, such as for example, buckwheat hulls, may allow people of different body types, physical dimensions and different needs to find a cushion that provides maximum comfort.

Visco-elastic foam (VEF) is also known as "memory" foam and has an open-cell type of flexible polyurethane foam, which can redistribute weight of G-Force magnitude, while providing general comfort over long periods of time. VEF is typified by its slow recovery after compression. When a human body, or other weighted object, is positioned on VEF, the foam progressively conforms to the shape of the object. Once the weight is removed, the foam slowly resumes its initial shape, which allows sitting cushion 1 and mat 10 to be used by different mediators over time.

Although most urethanes form fast-recovery foams that have a force approximately equal to the load, VEF has the ability to absorb shock because of its low resilience, and lack of the 'springiness' of other polyurethane foams. In addition, VEF reacts to body heat given off by the user of the mediation sitting cushion or mat, and softens the VEF to more easily adjust to body contours of the user to provide comfort for long mediation periods.

The viscous response of VEF provides a relatively even distribution of the user's weight, while the elastic response allows the foam to support a static load of the user's weight. VEF materials "flow" away from the point of contact and redistribute under the applied pressure of the weight. However, the force that is the elastic component of the equation is not proportional to the displacement. Since VEF can distribute the weight more evenly, the user can avoid pressure spots that can restrict blood circulation in the load bearing areas and account for discomfort and fatigue.

Body accommodating and heat sensitive visco-elastic bearing meditation cushion 1, with its superior "buttock envelopment" properties, holds the pelvis in correct alignment. This alignment leads to decreased strain and tension on supporting neuro-muscular and connective tissue structures to hold the body still in meditative positions. Therefore, VEF is an excellent support surface for meditators, especially when combined with a stable but accommodative supporting material such as buckwheat layers, or similar materials such as kapok or buckwheat hulls (in the case of the meditation cushion 1), and cotton batting support (in the case of the meditation mat 10).

VEF provides many advantages for use in a mediation sitting cushion. VEF has a slow recovery upon load removal, and therefore it does not return stored energy (for example, applied body weight) to the next user. It has a slow conformation to static loads while retaining a natural resistance to bottoming out during higher, short duration dynamic loading (such as when a person sits down on a meditation cushion). VEF has temperature sensitivity (softening as temperature rises), which provides a desirable softer zone adjacent to the skin, supported by a stiffer region away from the skin. This increases the supportive weight-bearing surface, a critical feature that allows a maximum weight distribution away from the usual weight-bearing areas of the 'sit bones' and knees of the meditator. VEF may be use in different densities, and indentation load deflection values, and thickness of materials, which can combine to allow the use of the different foams for different load weights for meditation cushion 1 and meditation mat 10.

Figure 1:
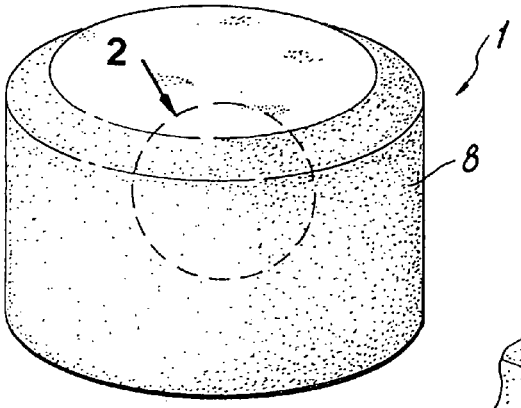
FIG. 1 shows a perspective view of a sitting cushion of visco-elastic foam and a supporting structure of buckwheat hulls encased in a covering.
Figure 2:
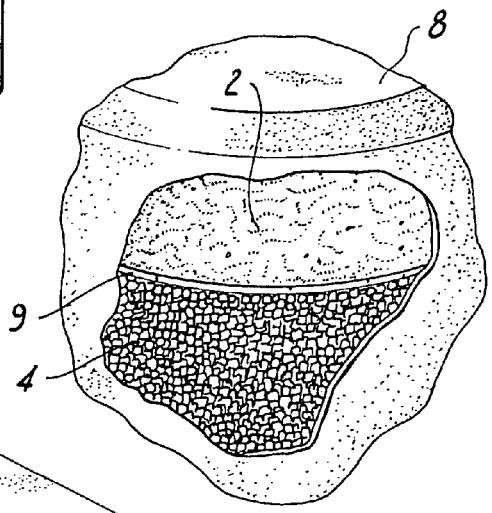
FIG. 2 shows a cross sectional detail view of the sitting cushion, taken along the dashed line circle "2" in FIG. 1.
Figure 6:
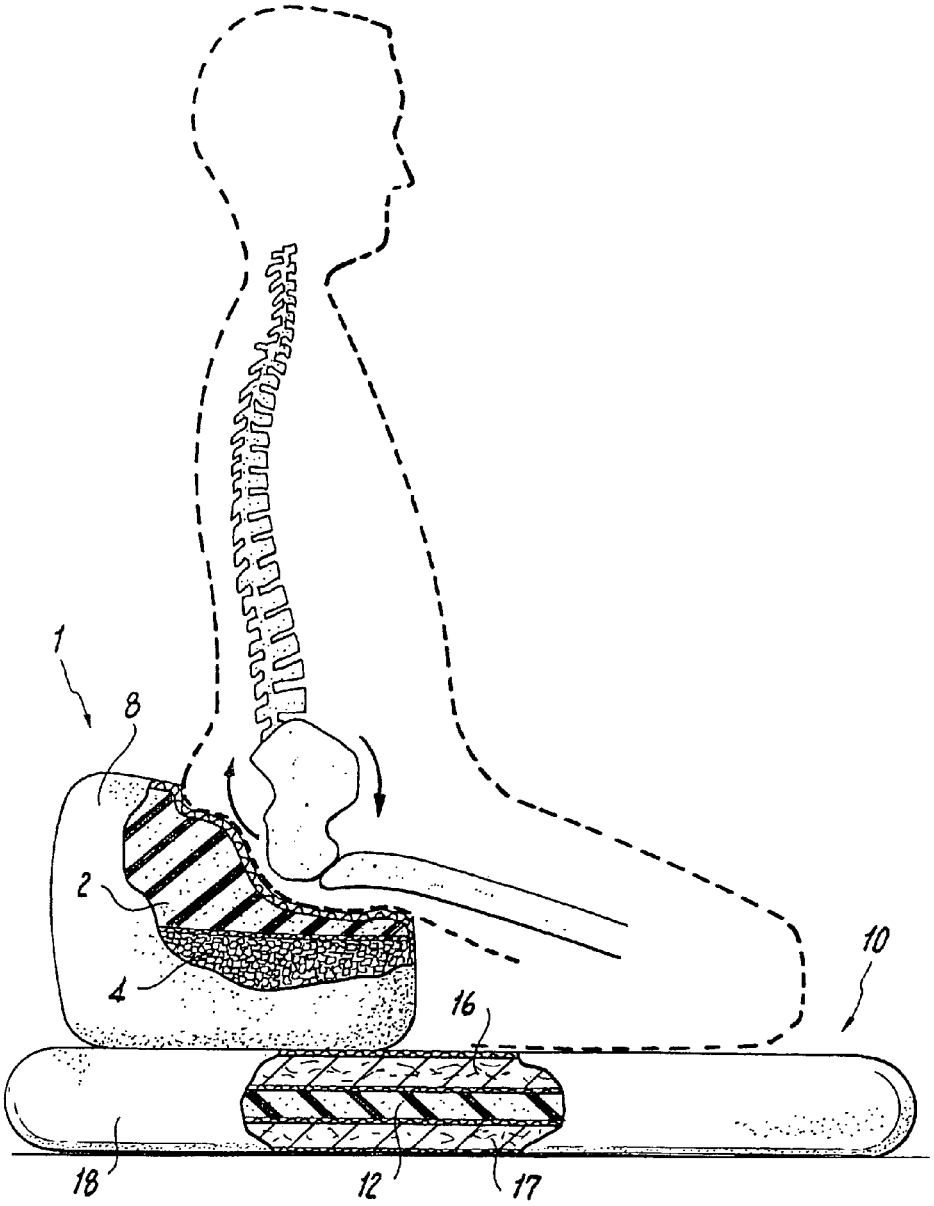

As depicted in FIGS. 1 and 2, mediation sitting cushion 1 may be formed in a generally cylindrical shape and can raise the user approximately 6 to 18 inches above the floor. Meditation cushion 1 incorporates upper visco-elastic foam (VEF) layer 2 of approximately 2-3 inches in depth having a density that is sufficient to support body weight and accommodate weight-bearing surface of the body that is in contact with VEF layer 2. This accommodation ensures the proper ergonomic postural position of the weight-bearing sit bones, thus promoting a forward curve in the lumbar spine and proper alignment of the head and neck, as shown in FIG. 6. Since the position of the pelvis will determine the shape of the spine due to the relatively rigid connection between the base of the spine and the pelvis, a slightly forward or neutral pelvic tilt automatically produces the optimal lumbar curve. Mediation sitting cushion 1 provides a location to engage the ischial tuberosities ("sitting bones"), and helps to tilt the pelvis forward while creating a pocket that holds the pelvis in this position. The full-length postural alignment supports the body in this neutral position, which the most efficient weight-bearing posture while sitting, and significantly decreases muscle, joint and skeletal stress and pain during mediations with prior art cushions and mats, over long periods in still positions, as shown in prior art FIG. 5.

As shown in FIGS. 1-2 and 6, base layer 4, such as a layer of beaded supportive material, such as a plurality of buckwheat hulls or a layer of other similarly supportive materials, such as, for example, spelt hulls or kapok, provides a firm base for the foam to rest on as a lower layer, and act as a base that is less compressive than upper VEF layer 2 to support the body weight of the user in a stable manner. The height of base layer 4 can variable and modified to accommodate a particular user, and typically base layer 4 can range from 6 to 15 inches. These typical ranges can result in a total mediation sitting cushion height for meditation cushion 1 of between approximately 8-18 inches. The diameter of meditation cushion 1 may also vary to accommodate a particular user, and can typically be from 8 to 15 inches in width. Other geometrically shaped cushions (not shown) such as square, rectangular, or variable shaped would be similarly sized. In addition, mediation sitting cushion 1 may be constructed to accommodate a wide variety of multiple users by employing larger dimensions.

As further shown in FIGS. 1-2 and 6, upper VEF layer 2 and lower base 4 of mediation sitting cushion 1 are preferably separated and protected by cover 8 and optional separation layer 9, which may be of any durable material, for example, cotton, muslin, cotton polyester blends, synthetic materials and the like.

The construction of mediation sitting cushion 1 (as shown in FIGS. 1-2 and 6), using upper VEF layer 2 in combination with supporting lower base layer 4, allows for a firm but accommodative base surface that maximizes comfort, maintains stability and provides a long lasting and consistent supportive surface in meditation, while holding the pelvis in a neutral or slightly anterior aligned pelvic position. Lower base layer 4, such as a buckwheat base layer, prevents the over-compression of upper VEF layer 2 of the mediation sitting cushion 1, which would results in changes in height and lead to incorrect positioning.

As shown in FIGS. 3-4 and 6, meditation mat 10 contains middle VEF layer 12, which may typically be 2-3 inches thick, as in FIG. 4. Middle VEF layer 12 is located between respective upper and lower batting layers 16, 17, typically cotton or other durable material, located respectively above and below middle VEF layer 12. Middle VEF layer 12 surrounded by upper and lower batting layers 16, is protected by cover 18 which may be of any durable material, for example, cotton, muslin, cotton polyester blends, synthetic materials and the like. Middle VEF layer 12 is preferably separated from upper and lower batting layers 16 by separation layers 19 and 20. The size of meditation mat 10 may typically be 3-6 inches in height, and typically range approximately from 20 to 30 inches in length and width.

Mediation mat 10 (as shown in FIGS. 3-4 and 6) is typically used under mediation sitting cushion 1, although both may also be used individually, to lessen or prevent painful pressure on the users' knees where contact is made with the floor or traditional mats during long periods of sitting. Mediation mat 10 can lessen or prevent pain in the knees and other joints whether the user is sitting in a cross-legged posture in which the lateral (outside) portion of the knees bears the weight, or in a kneeling posture where weight is borne on the inferior portion of the kneecaps.

It is further known that while the preferred embodiment is use of the combination of meditation cushion 8 and meditation mat 10 together, it is known that each can be used separately during meditation.

In the foregoing description, certain terms are used to illustrate the preferred embodiment. However, no unnecessary limitations are to be construed by the terms used, since the terms and illustrations are exemplary only, and are not meant to limit the scope of the present invention.

It is further known that other modifications may be made to the present invention, without departing the scope of the invention, as noted in the appended Claims.

I claim:

1. A cylindrically shaped meditation sitting cushion comprising:

a single, upper layer of slow recovery, low resilience, temperature sensitive visco-elastic foam having a generally planar first support surface and a generally planar second surface, the first and second surfaces defining therebetween a substantially uniform thickness of about 2 to 3 inches;

a lower, less compressive supporting layer consisting essentially of buckwheat hulls for providing a firm base of support, said lower compressive supporting layer having a generally planar third surface and a generally planar fourth surface, the third and fourth surfaces defining therebetween a substantially uniform thickness of about 3.5 to 6.5 inches; and a cover material enclosing said upper and lower layers;

wherein said upper and lower layers so configured to a combined substantially uniform thickness of about 5.5 to 9.5 inches operate to maintain a pelvis and spine of a user seated upon the meditation cushion in an alignment that minimizes musculature and ligamentous strain during use as intended.

2. A cylindrically shaped meditation sitting cushion comprising:

a single, upper layer of slow recovery, low resilience, temperature sensitive visco-elastic foam having a generally planar first support surface and a generally planar second surface, the first and second surfaces defining therebetween a substantially uniform thickness of about 2 to 3 inches;

a lower, less compressive supporting layer consisting essentially of buckwheat hulls for providing a firm base of support, said lower compressive supporting layer having a generally planar third surface and a generally planar fourth surface, the third and fourth surfaces defining therebetween a substantially uniform thickness of about 3.5 to 6.5 inches; and a cover material enclosing said upper and lower layers.

3. The meditation sitting cushion of claim 2, further comprising a separation layer of durable material located between said upper and lower layers.

4. The meditation sitting cushion of claim 2, wherein said cover material is a durable fabric.

5. The meditation sitting cushion of claim 4, wherein said cover material is a cotton fabric.

6. A meditation sitting cushion consisting essentially of:

a cylindrical body;

said cylindrical body having a single, upper layer of slow recovery, low resilience, temperature sensitive visco-elastic foam having a generally planar first support surface and a generally planar second surface, the first and second surfaces defining therebetween a substantially uniform thickness of about 2 to 3 inches;

said cylindrical body further having a lower, less compressive supporting layer of material consisting essentially of buckwheat hulls for providing a firm base of support, said lower compressive supporting layer having a generally planar third surface and a generally planar fourth surface, the third and fourth surfaces defining therebetween a substantially uniform thickness of 3.5 to 6.5 inches;

said cylindrical body further having a separation layer of durable material positioned between said upper and lower layers; and a cover material enclosing said upper and lower layers of said cylindrical body.

7. The meditation sitting cushion of claim 6, wherein said cover material is a cotton fabric.

* * * * *